United States Patent [19]

Harada et al.

[11] Patent Number: 4,870,460

[45] Date of Patent: Sep. 26, 1989

[54] METHOD OF CONTROLLING SURFACE POTENTIAL OF PHOTOCONDUCTIVE ELEMENT

[75] Inventors: Masahide Harada; Kazuhiro Kimura, both of Tokyo, Japan

[73] Assignee: Ricoh Company, Ltd., Tokyo, Japan

[21] Appl. No.: 128,923

[22] Filed: Dec. 4, 1987

[30] Foreign Application Priority Data

Dec. 5, 1986 [JP] Japan ..... 61-289805
Dec. 5, 1986 [JP] Japan ..... 61-289807

[51] Int. Cl.[4] ..... G03G 15/00

[52] U.S. Cl. ..... 355/246; 355/327; 430/30; 430/902

[58] Field of Search ..... 355/3 R, 3 DR, 3 CH, 355/14 CH, 14 R, 14 D, 14 E, 3 DD, 4; 430/30, 31, 902

[56] References Cited

U.S. PATENT DOCUMENTS

| | | | |
|---|---|---|---|
| 4,312,589 | 1/1982 | Brannan et al. | 355/3 CH X |
| 4,372,674 | 2/1983 | Yukawa et al. | 355/14 E X |
| 4,484,811 | 11/1984 | Nakahata et al. | 355/14 CH |
| 4,551,005 | 11/1985 | Koichi | 355/14 E X |
| 4,583,835 | 4/1986 | Harada | 355/14 CH |
| 4,619,522 | 10/1986 | Imai | 355/14 D |
| 4,632,537 | 12/1986 | Imai | 355/3 DD X |
| 4,734,740 | 3/1988 | Fujii et al. | 355/14 R |

*Primary Examiner*—A. T. Grimley
*Assistant Examiner*—Robert Beatty
*Attorney, Agent, or Firm*—Oblon, Spivak, McClelland, Maier & Neustadt

[57] ABSTRACT

A control method applicable to an electrophotographic copier for protecting the background of copies against smears due to a residual potential on a photoconductive element. Before a visible pattern is produced, the photoconductive element is charged by a lower potential than a charging potential which is adapted to form a document image and, then, it is discharged. Potential remaining on the photoconductive element which has been discharged is developed to produce the visible pattern, and the density of this pattern is optically detected. Based on the density level of the visible pattern detected, at least one of a developing bias potential, a charging potential and an exposing potential which are to form a document image is corrected. In the event of producing the visible pattern, the potential remaining on the photoconductive element is developed by a developing bias potential which has been corrected on the bias of visible pattern density level detected immediately before. In a multi-color electrophotographic copier which uses a plurality of colors of toner, the visible pattern is produced by using one particular color of toner which is advantageously black toner.

5 Claims, 20 Drawing Sheets

POWER ON
INITIAL ALL OUTPUTS TO OFF STATE
CLEAR ALL COUNTERS
(Tc),(Tt),(Tb),(Td)
ACCEPT TIMER INTERRUPTION, SET TIMER & START TIMER
2
READ INPUT STATE
ALL TRIGGERS OFF?
YES
NO
TIMER FLAG TF SET?
NO
VALID TIMING ?
NO
YES
MEASURE DRUM SPEED
CALCULATE SET CURRENT AND VOLTAGE

1
STATE COUNTER=0 ?
YES
NO
ADMIT AD CONVERSION
START BIT CHECK
3
INCREMENT STATE COUNTER BY ONE
STATE COUNTER=9 ?
NO
YES
1-BIT AD CONVERSION
3
INHIBIT AD CONVERSION
STORE AD CONVERTED DATA
FUNCTION COUNTER= ?

INPUT STATE READING

TIMER INTERRUPTION

DRIVE LINEAR VELOCITY MEASUREMENT

CURRENT/ VOLTAGE SET VALUE OPERATION

PULSE WIDTH COUNTER CHECK & TRIGGER INPUT CHECK

AD CONVERSION & START BIT CHECK

1-BIT AD CONVERSION

C CURRENT PROPORTIONAL OPERATION

T CURRENT PROPORTIONAL OPERATION

B VOLTAGE PROPORTIONAL OPERATION

D VOLTAGE PROPORTIONAL OPERATION

PWM

RESIDUAL POTENTIAL CORRECTION OPERATION

METHOD OF CONTROLLING SURFACE POTENTIAL OF PHOTOCONDUCTIVE ELEMENT

BACKGROUND OF THE INVENTION

The present invention relates to a method of controlling the surface potential of a photoconductive element which is installed in an electrophotographic copier and other electrostatic recording equipment to serve as an image carrier.

In an electrophotographic copier, for example, as a predetermined copying cycle repeatedly occurs, a potential is caused to remain on a photoconductive element due to the fatigue of the element even after the element has been discharged, as is well known in the art. The potential remaining on the photoconductive element, or residual potential, sequentially increases with the number of copies produced (number of copying cycles repeated). As the residual potential level reaches a certain threshold level, it causes smears to appear in the background of a copy.

One approach heretofore proposed to eliminate such smears in the background consists in measuring the residual potential on the photoconductive element by a special potential sensor, comparing the potential measured with a predetermined reference value, and correcting a developing bias voltage based on the result of comparison. This approach which relies on a potential sensor not only incurs extra costs, but also suffers from the influence of temperature and other ambient conditions. Any error in the direction of residual potential would lead to the contamination of the background of a copy.

Another approach known in the art is such that a visible pattern is formed based on a residual potential on the photoconductive element, then the density of the visible pattern is optically sensed, then residual potential on the photoconductive element is determined in terms of the density level sensed, and then at least one of a developing bias potential, a charging potential or an amount of exposure is corrected based on the residual potential level in the event of forming a document image on the photoconductive element.

The visible pattern scheme stated above has a drawback as follows. Despite that the residual potential, on a photoconductive element, usually sequentially increases on a 1,000 to 10,000 copy basis, i.e., it does not noticeably change to the negative side from a level as determined immediately before, the visible pattern mentioned above is formed by using a constant developing bias potential. This causes the amount of toner consumed to produce the visible pattern to increase with the residual potential, thereby aggravating the waste of toner. Furthermore, upon the rise of the residual potential beyond a predetermined value, the density of visible pattern becomes saturated to render accurate detection impracticable.

Another drawback with the above-described prior art scheme is that when the quantity of light issuing from an eraser is so reduced that a potential on the photoconductive element fails to be fully removed, the residual potential due to the fatigue of the element itself and the residual potential ascribable to the short quantity of light are combined together. In this condition, the visible pattern itself cannot serve as a reliable reference for the correction of potential on the photoconductive element, resulting that the amount of correction is inaccurate.

The visible pattern scheme which does not specify any color of toner for producing the visible pattern brings about another problem when applied to a multicolor electro-photographic copier in which a plurality of different colors of toner are selectively supplied. Specifically, in such an application, since it sometimes occurs that the color of toner for producing the visible pattern differs from one copying cycle to another, the reference for detection and, therefore, the level detected is changed depending upon the kind of toner used. This lowers the accuracy of correction of potential on the photoconductive element.

SUMMARY OF THE INVENTION

It is, therefore, an object of the present invention to provide a method of controlling a potential on a photoconductive element of an electrophotographic copier which frees the background of a copy from smears otherwise caused by a residual potential on the element.

It is another object of the present invention to provide a method of controlling a potential on a photoconductive element of an electrophotographic copier which accurately measures a residual potential on the element.

It is another object of the present invention to provide a method of controlling potential on a photoconductive element of an electrophotographic copier which allows a minimum of loss to occur in the consumption of toner which is necessary to form a visible pattern based on a residual potential.

It is another object of the present invention to provide an accurate method of controlling a potential on a photoconductive element of an electrophotographic copier which confines the density of a visible pattern derived from a residual potential on the element in particular, wherein the detection level is prevented from being saturated.

It is another object of the present invention to provide a method of controlling potential on a photoconductive element of a multi-color electrophotographic copier which enhances accurate correction of a potential on the element.

A method of controlling a surface potential of a photoconductive element which is installed in an image-forming apparatus of the present invention comprises the steps of (a) discharging an area of a surface of the photoconductive element other than an image-forming area for forming a document image which corresponds to an original document, (b) producing a visible pattern by developing a potential which remains on the area of the photoconductive element other than the image-forming area after step (a), by using a developing bias potential which is lower than a developing bias potential for forming the document image, (c) detecting density of the visible pattern, and (d) correcting at least one of a charging potential, an exposing potential and a developing bias potential which are to form the document image, based on the density detected.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The general principle of the present invention will be described first.

Figure 1:
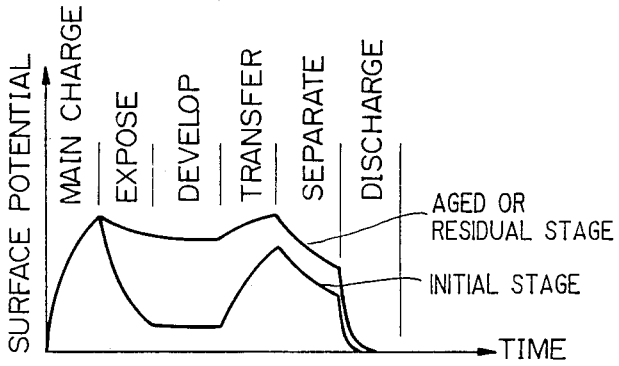
FIG. 1 is a graph showing a surface potential on a photoconductive element of an electrophotographic copier which varies as a copying process proceeds.
Figure 2A:
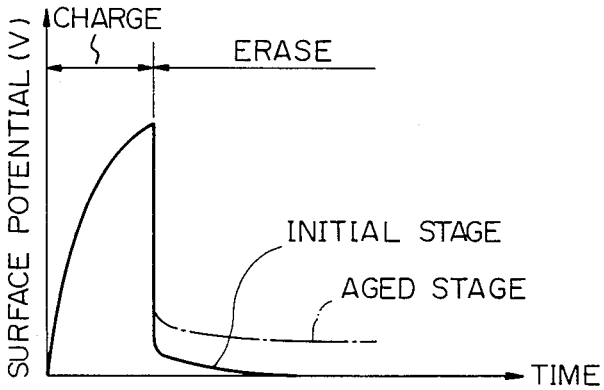
FIGS. 2A and 2B are graphs each showing the variation of surface potential on a photoconductive element with respect to time.
Figure 2B:
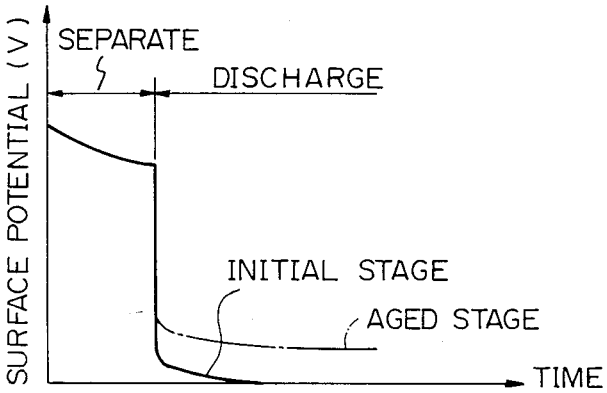

As shown in FIG. 1, in an electrophotographic copier, the surface potential of a photoconductive element varies as the copying process advances from a main charging step to a discharging step through an exposing step, a developing step, a transferring step, and a separating step. The surface potential of a photoconductive element is, in principle, expected to be substantially at zero volts after full-surface erasure or when discharged by light at the end of a copying cycle. In practice, however, some residual potential is detected on the surface of the photoconductive element even after the full-surface erasure or the discharging by light, as shown in FIGS. 2A and 2B by way of example. In addition, as previously stated, the residual potential on the photoconductive element increases in proportion to the number of copying cycles performed, i.e., the number of copies produced, causing smears to appear in the background of a copy.

Figure 3A:
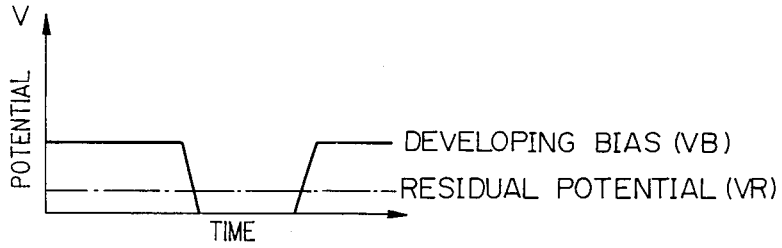
FIGS. 3A and 3B are graphs showing in combination a relationship between a developing bias voltage and residual potential and an amount of toner deposition.
Figure 3B:
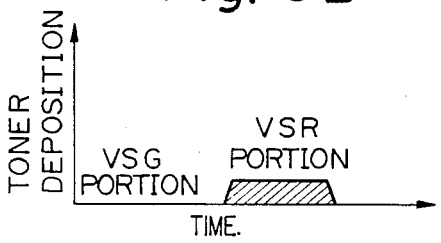
Figure 4:
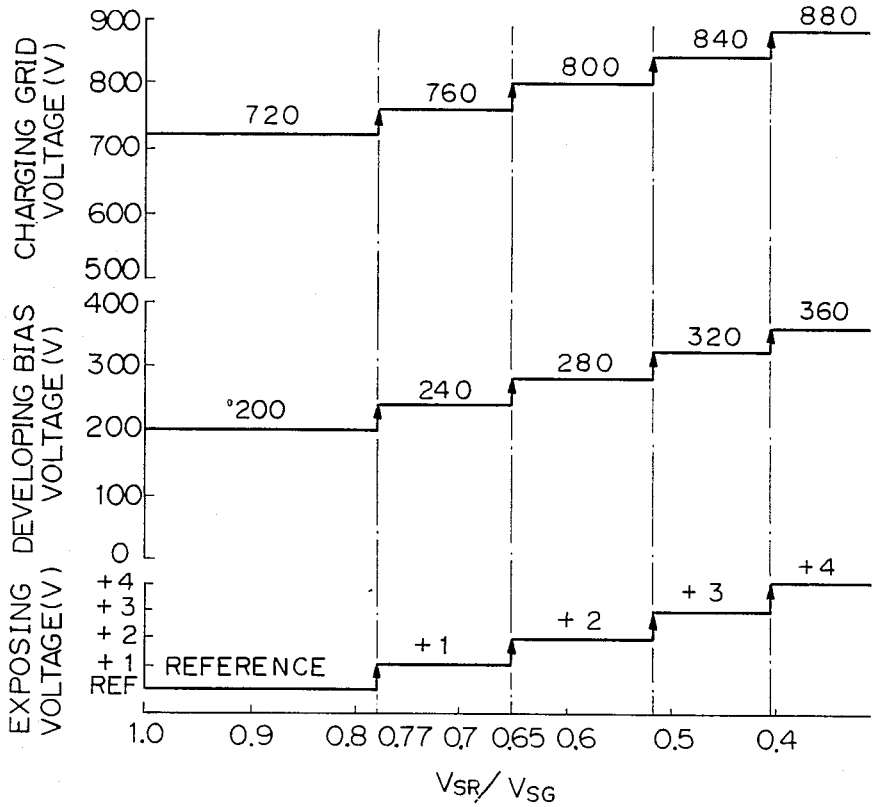
FIG. 4 is a graph showing a rate of increase of a residual potential with respect to each of a charging grid voltage, a developing bias voltage, and an exposing voltage.

On the other hand, by using the residual potential, it is possible to cause an amount of toner corresponding to the residual potential to be deposited on a non-image-forming area of the photoconductive element if a lower developing bias voltage (preferably zero volt) than in an image-forming area of the element is applied to the non-image-forming area, as shown in FIGS. 3A and 3B, by way of example. It follows that a residual potential on the photoconductive element can be determined by sensing the toner pattern, or visible pattern, deposited due to the residual potential by using a pattern sensor. Hence, contamination in the background of the image-forming area of the photoconductive element can be eliminated by comparing the output level of the pattern sensor with a reference level (e.g. output level associated with a portion of the photoconductive element in which the visible pattern is not formed), and by increasing the developing bias voltage stepwise based on the ratio of the sensor output level to the reference level, as shown in FIG. 4.

Figure 5:
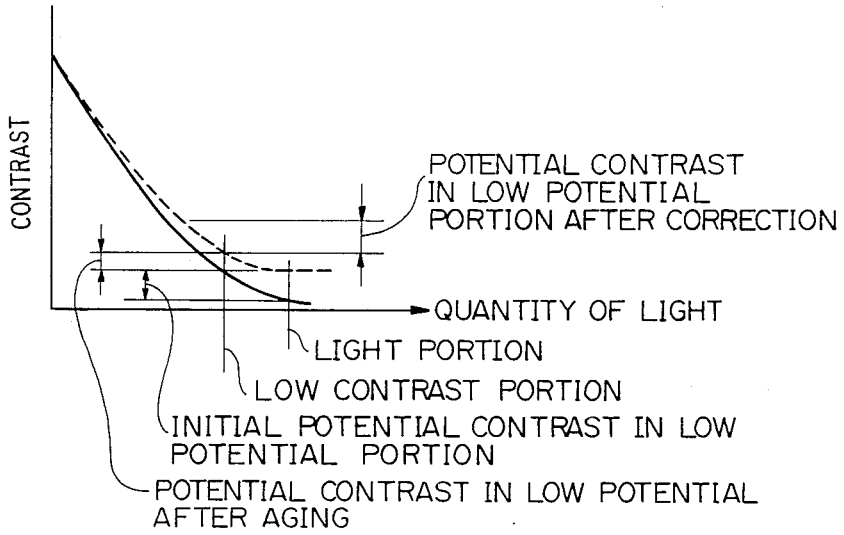
FIG. 5 is a graph useful for explaining a potential contrast in a low potential portion which is developed by an increase in background potential which is in turn caused by an increase in residual potential.
Figure 6:
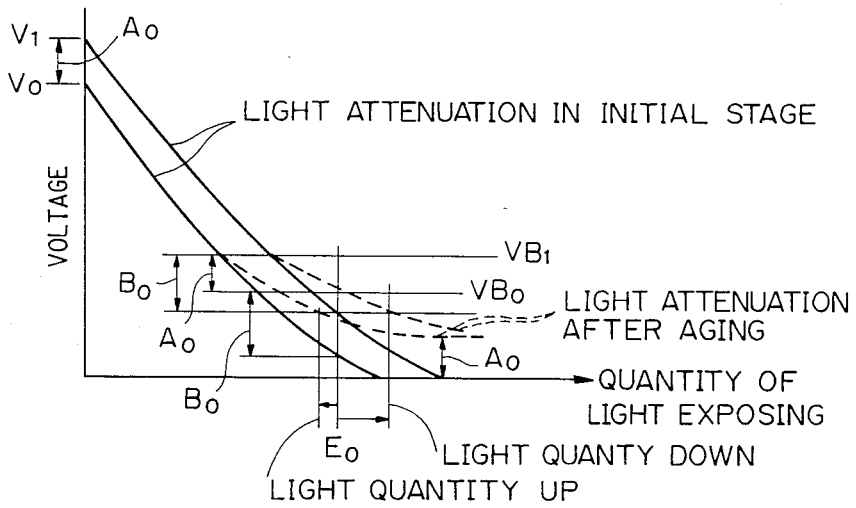
FIG. 6 is a graph showing a light attenuation characteristic of a photoconductive element.

As shown in FIG. 5, as the background potential increases with the residual potential, the potential contrast in a low potential portion is lowered resulting that a low-contrast original document such as one prepared by use of a pencil fails to be copied with high reproducibility. In the light of this, the quantity of exposing light is reduced simultaneously with the correction of the developing bias voltage. Further, since the increase in developing bias voltage causes the difference between the potential of a dark area and the developing bias voltage in terms of potential and, therefore, the image density to decrease, main charging is controlled in such a manner as to raise the potential in a dark area as well, thereby stabilizing the potential of a latent image all the time. While the quantity of exposing light is so controlled as to decrease because, should the charging potential be not corrected to increase, as shown in FIG. 5, the potential contrast would be lowered, it is necessary to increase the quantity of exposing light when the charging potential is increased. FIG. 6 shows a light attenuation characteristic of a photoconductive element. In FIG. 6, $VB_0$ is representative of an initial developing bias voltage (set value), and $E_0$ an initial quantity of exposing light. The residual potential is increased by $A_0$ due to aging. Since the potential contrast which is $B_0$ for the initial background contamination becomes $VB_0-B_0<VB_1-B_0$ when the developing bias voltage is increased from $VB_0$ to $VB_1$ by $A_0$. Further, when the charging potential deposited on a photoconductive element is increased from $V_0$ to $V_1$ by $A_0$, the potential contrast becomes $VB_0-B_0>VB_1-B_0$ and, hence, the amount of exposure has to be increased beyond the set value.

Figure 8:
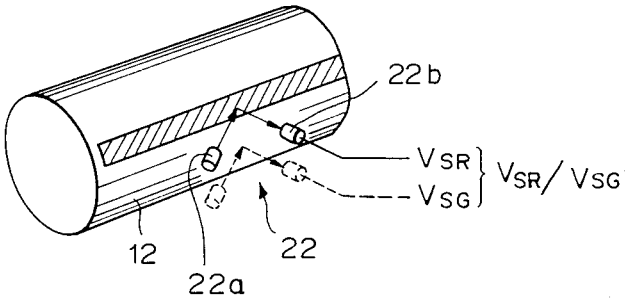
FIG. 8 is a perspective view of a pattern sensor responsive to a visible pattern as shown in FIG. 7.
Figure 7:
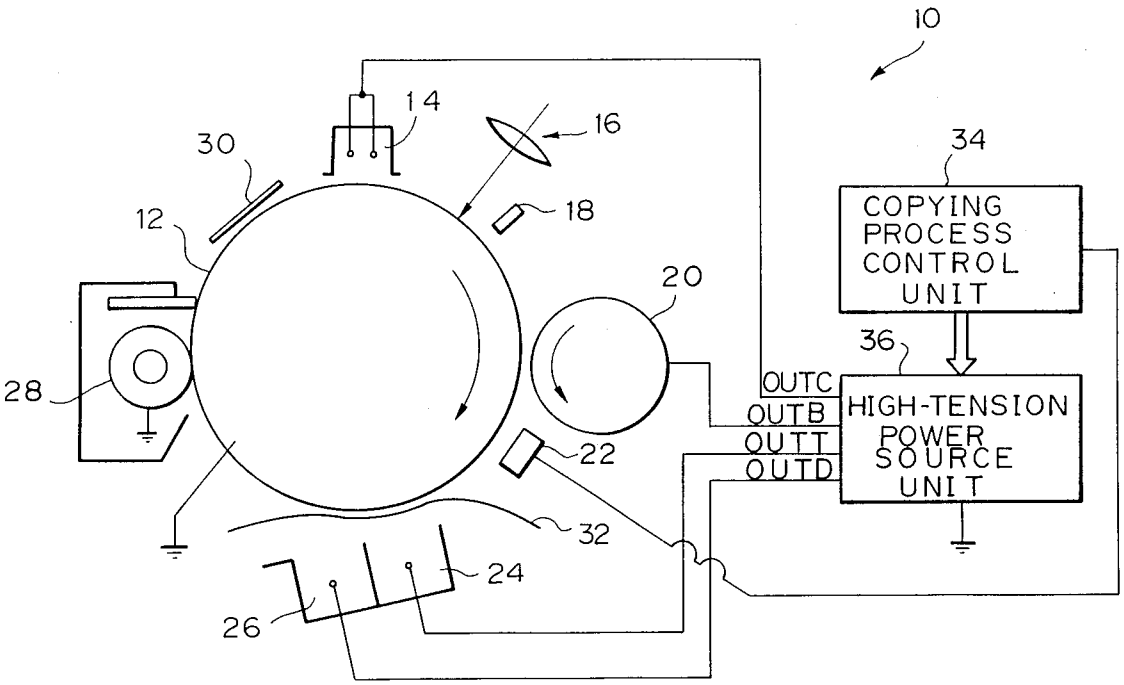
FIG. 7 is a schematic diagram showing a drum, various elements arranged around the drum, and a power source device of a copier to which the present invention is applied.

Referring to FIG. 7, there is shown an electrophotographic copier 10 to which a method of controlling a potential of a photoconductive element is applied is shown. The copier 10 includes a photoconductive drum 12 around which a charger 14, optics 16 for exposure, an eraser 18, a developing unit 20, a pattern sensor 22 responsive to a visible pattern, a transfer unit 24, a separator unit 26, a cleaning unit 28 and a discharger 30 are arranged at individual positions which are adequate for performing a predetermined copying process. While the drum 12 is rotated by a motor, not shown, it is uniformly charged by the charger 14, then exposed imagewise to form an electrostatic latent image thereon, and then discharged by light issuing from the eraser 18 except for its image-forming area. The latent image on the drum 12 is developed by the developing unit 20 and, then, transferred by the transfer unit 24 to a paper sheet 32 which is fed out from a sheet feeder, not shown. The paper sheet 32 is separated from the drum 12 by the separator unit 26 and, then, driven to a fixing unit, not shown, to fix toner thereon. On the other hand, the drum 12 is cleaned by the cleaning unit 28 after the separation of the paper sheet and, subsequently, discharged throughout its surface by the discharger 30. As shown in FIG. 8, the pattern sensor 22 is constituted by a light-emitting element 22*a* and a light-sensitive element 22*b*. The pattern sensor 22 is connected to a copying process control unit 34. The developing unit 20 is connected to a bias output terminal OUTB of a high-tension power source unit 36. The electrodes of the charger 14, transfer unit 24 and separator unit 26 are connected, respectively, to output terminals OUTC, OUTT and OUTD, of the high-tension power source unit 36. This power source unit 36 is operated to feed power to those electrodes at predetermined different timings in response to commands as output by the copying process control unit 34.

Figure 9:
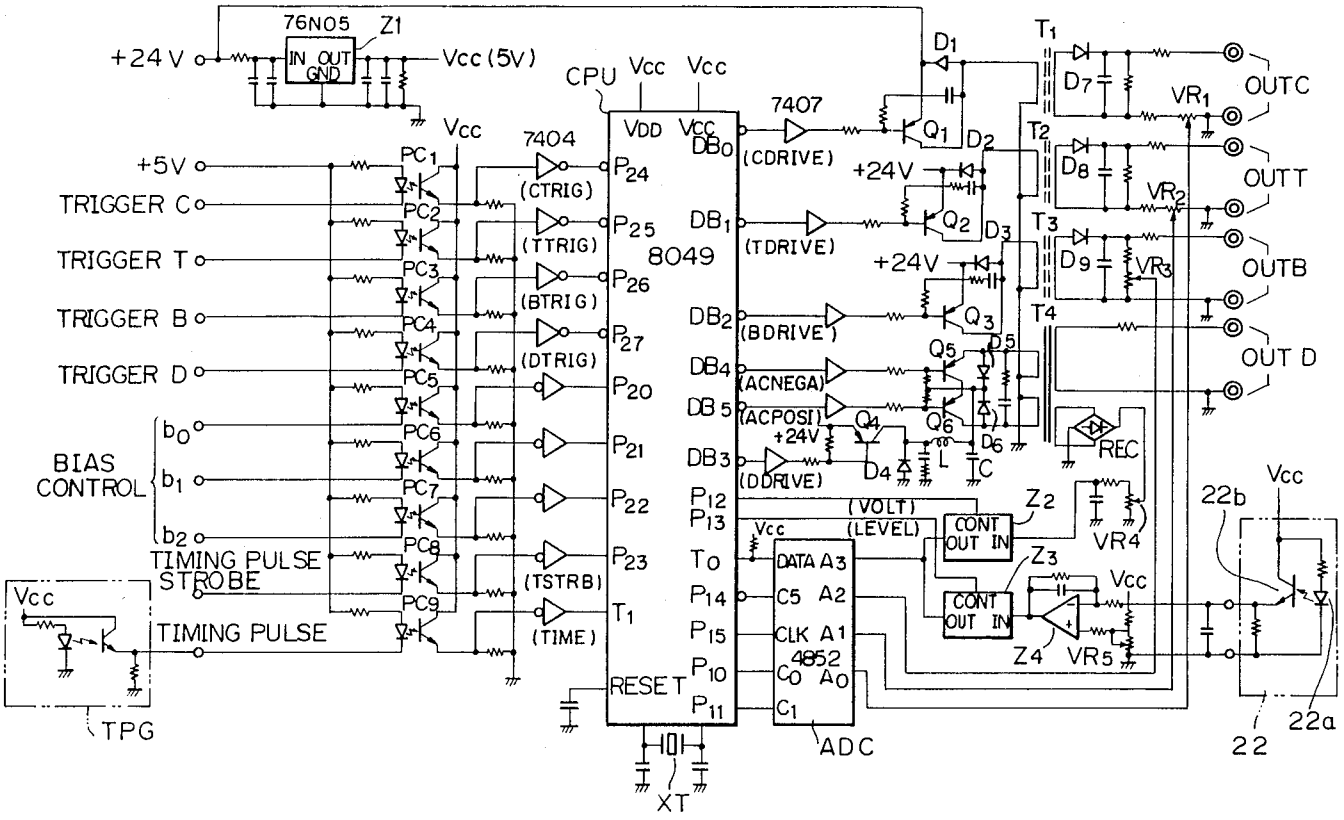
FIG. 9 is a circuit diagram representative of a high-tension power source unit as also shown in FIG. 7.

FIG. 9 shows a circuit arrangement of the high-tension power source unit 36. It is to be noted that in FIG. 9 a circuit for converting a commercially available AC power source (for example 100 volts) into 24 volts DC is omitted. A microcomputer CPU controls power source unit 36 and, in this specific arrangement, may be implemented with a single-chip microcomputer (such as a conventional 8049 processor). The microcomputer CPU has input ports P24, P25, P26, P27, P20, P21, P22, P23 and T1 to which are applied, respectively, signals appearing on the output terminals of photocouplers PC1, PC2, PC3, PC4, PC5, PC6, PC7, PC8 and PC9 each via an inverter (7404). The input terminals of the photocouplers PC1 to PC9 are individually associated with a charge voltage input terminal (C TRIGGER), a transfer voltage input trigger terminal (T TRIGGER), a developing bias voltage input terminal (D TRIGGER), developing bias control terminals (b0, b1 and b2), a timing pulse input terminal, and a timing pulse read terminal. The input terminals of the photocouplers PC1 to PC8 are connected to output terminals of the copying process control unit 34. Connected to the input terminal of the photocoupler PC9 is an output terminal of a timing pulse generator TPG. The timing pulse generator TPG optically senses the rotation of a slitted disk, not shown, which is rotated integrally with the drum 12, thereby generating timing pulses which are synchronous to the rotation of the drum 12.

An analog-to-digital (AD) converter ADC (4052) is connected to output ports P14, P15, P10 and P11 and an input port T0 of the microcomputer CPU. Provided with four signal input terminals A0, A1, A2 and A3, the AD converter ADC converts either one of four input voltages into eight-bit digital data in response to a signal applied to its channel selection input terminals C0 and C1 and clocked by a signal applied to its clock input terminal CLK. The eight-bit digital data are sequentially applied to an output terminal DATA one bit at a time. Pulse transformers T1, T2, T3 and T4 are connected to ground at their primary winding side. Drivers individually including switching transistors Q1, Q2, Q2 and Q4 are individually connected to the other winding side of the pulse transformers T1, T2, T3 and T4 at their output terminals. Power of DC 24 volts is fed to the input terminals of the respective drivers, i.e., emitters of the transistors Q1, Q2 and Q3.

Control input terminals of the drivers, i.e., bases of the transistors are individually connected to output ports DB0, DB1, DB2 and DB3 of the microcomputer CPU each via a buffer (7404). The primary winding of the pulse transformer T4 is segmented into two while a driver associated with this pulse transformer T4 is provided with two additional switching transistors Q5 and Q6 for selecting one of the two segments which is to be energized. The input terminals of the transistors Q5 and Q6 are connected to, respectively, output ports DB4 and DB5 of the microcomputer CPU via buffers.

A rectifying and smoothing circuit which includes a diode and a capacitor is associated with the secondary winding of each of the pulse transports T1, T2 and T3 or that of the pulse transformer T4. Disposed in the vicinity of the rectifying and smoothing circuits are, respectively, variable resistors VR1, VR2, VR3 and VR4 each being adapted to detect the output level of its associated power source. A signal amplifier circuit which includes an operational amplifier (OP AMP) Z4 and a variable resistor VR5 is connected to an output terminal of the pattern sensor 22 which is implemented with a reflection type photosensor and adapted to optically sense the density of a visible pattern, which is developed by a residual potential on the drum 12.

The output terminals (sliders) of the variable resistors VR1, VR2 and VR3 are connected to, respectively, signal input terminals A0, A1 and A2 of the AD converter ADC. The output of the variable resistor VR4 and that of the OP AMP Z4 are coupled to a signal input terminal A3 of the AD converter ADC via analog switches Z2 and Z3, respectively. Control input terminals (CONT) of the analog switches Z2 and Z3 are connected to, respectively, output ports P12 and P13 of the microcomputer CPU. The power source Vcc (5 volts) of the control circuit is provided by a DC voltage regulator Z1.

Referring to FIGS. 10A, 10B, 11A, 11B, 12A to 12C, and 12E to 12N, the operation of the microcomputer CPU is shown. The functions assigned to the various ports of the microcomputer CPU, the definitions of a timer and counters which will appear, and those of operational registers are shown below in Tables 1, 2 and 3.

TABLE 1

| ASSIGNMENT OF PORTS | | | | | |
|---|---|---|---|---|---|
| TERMINAL | input/ output | BIT | LABEL | FUNCTION | NOTE |
| | | 0 | (CDRIVE) | C power source drive | negative logic |
| | | 1 | (TDRIVE) | T power source drive | negative logic |
| | | 2 | (BDRIVE) | B power source drive | negative logic |
| DB | output | 3 | (DDRIVE) | D power source drive | negative logic |
| | | 4 | (ACNEGA) | AC positive drive | negative logic |
| | | 5 | (ACPOSI) | AC positive drive | negative logic |
| | | 6 | — | — | |
| | | 7 | — | — | |
| | | 0 | (C0) | ADC input | |
| | | 1 | (C1) | ADC input | |
| | | 2 | (VOLT) | voltage select | positive logic |
| P1 | output | 3 | (TEMP) | temp select | positive logic |
| | | 4 | (CS) | chip select | negative logic |
| | | 5 | (CLK) | clock | |
| | | 6 | — | — | |
| | | 7 | — | — | |
| | | 0 | (BCON) | bias | positive logic |
| | | 1 | (BCON) | bias | positive logic |
| | | 2 | (BCON) | bias | positive logic |
| P2 | input | 3 | (TSTRB) | strobe | negative logic |
| | | 4 | (CTRIG) | C trigger | negative logic |
| | | 5 | (TTRIG) | T trigger | negative logic |
| | | 6 | (BTRIG) | B trigger | negative logic |
| | | 7 | (DTRIG) | D trigger | negative logic |
| T0 | input | — | DATA | converted data | positive logic |
| T1 | input | — | TIME | timing | — |

TABLE 2

| DEFINITION OF TIMER & COUNTER | | | |
|---|---|---|---|
| LABEL | NAME | FUNCTION | SET VALUE |
| (T) | interruption timer | sequence ref clock | N(254) |
| (PCNT) | pulse width counter | pulse width set TC, TT, TB & TD | |
| (SCNT) | state counter | sequence state control | 9 |
| (FCNT) | function counter | sequence function control | 4 |
| (ACNT) | AC counter | D power source freq set | I(12) |

TABLE 3

| DEFINITION OF OPERATIONAL REGISTER | | | | | | |
|---|---|---|---|---|---|---|
| KIND OF DATA | VARIABLE | REGISTER | C power source | T power source | B power source | D power source |
| | detected value | (v) | — | — | — | — |
| voltage | set value | (S) | SC | ST | (SB) | SD |
| | deviation | (E) | — | — | — | — |
| | ref value | (G) | GC | GT | GB | GD |
| time | set value | (TM) | TC | TT | TB | TD |
| | manipulated value | (TE) | — | — | — | — |
| constant | gain | (K) | KC | KT | KB | KD |

It is to be noted that in the figures and the following description those labels which are in parenthesis are representative of the contents of registers and input-/output ports while those which are not in parenthesis are representative of practical data values.

When a power switch, not shown, is turned on, all the output ports are initialized to OFF level while, at the same time, internal resistors TC, TT, TB and TD adapted to hold control pulse widths associated with the individual power source lines are loaded with predetermined values which make their output pulse duties ((TC/TP), (TT/TP), (TB/TP), and (TD/TP) where TP is a pulse period) about 30 to 50 percent. A timer interruption is accepted, then a timer is set to a predetermined value, then the timer is started. This timer is a programmable hardware timer which is built in the microcomputer CPU. In an operation mode in accordance with the illustrative embodiment, when a predetermined count is reached, an internal interruption is generated with an interrupt flag TF set.

Figure 12A:
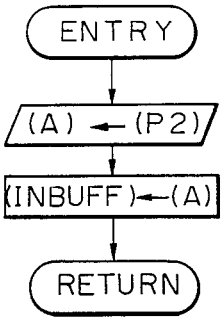
FIGS. 12A, 12C, 12E, 12F, 12G, 12H, 12I, 12J, 12K, 12L, 12M and 12N are flowcharts showing details of the processing as shown in FIG. 11A or 11B.
Figure 12B:
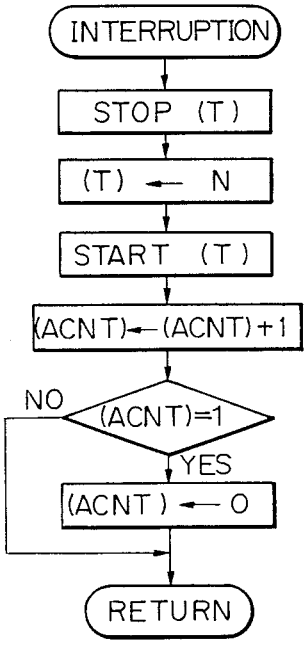
FIG. 12B is a flowchart showing timer interrupt processing.

When an internal interruption is accepted, a timer interruption is generated upon the lapse of a predetermined period of time after the instant when the timer has been started. In response, the microcomputer CPU interrupts the processing under way and enters a timer processing routine as shown in FIG. 12B. In the timer interruption processing, the timer is stopped, then it is loaded with a predetermined value N again, then it is started, and then an AC counter (ACNT) is incremented by one. The AC counter is cleared to zero when it reaches a predetermined count I. In the timer interruption processing, since the program returns with the timer set again, the timer interruption constantly occurs at a predetermined period TP, FIG. 12C.

Monitoring the timer flat TF which is set by each timer interruption, the microcomputer CPU executes single loop processing in response to each timer interruption. So long as the loop processing is not necessary, i.e., when all the commands (triggers) for turning ON the various power sources are OFF (e.g. immediately after the power-ON of the copier), the microcomputer CPU checks the period of the timing pulses to measure the linear velocity of the drum 12 and, based on the linear velocity measured, sets target control values (voltages or currents) of individual power source outputs.

Figure 12C:
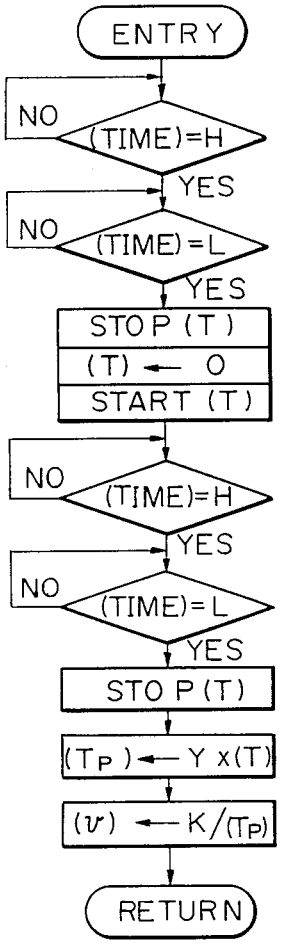
Figure 12D:
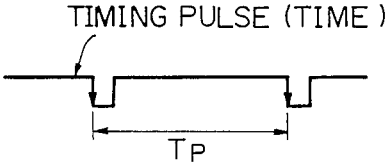
FIG. 12D is a waveform diagram showing a timing pulse.

The above procedure is adopted so that the same power source unit may be applicable to various copiers which are different in drum linear velocity from each other. The linear velocity is measured by a drum linear velocity measurement subroutine as shown in FIG. 12C. As shown in FIGS. 12C and 12D, the timing at which the timing pulses changes from (logical) high level, or H, to (logical) low level, or L, is determined to start the timer at that timing. Upon the next change of the timing pulse from high level to low level, the timer is stopped to read its content. This content of the timer is multiplied by a constant $\gamma$ (clock pulse period of the timer) and, then, the reciprocal of the product is multiplied by a constant k to produce a value (v) which is the drum linear velocity. In this example, the constant $\gamma$ is 43.6 microseconds, k is 1 millimeter, and (v) is 229 millimeters per second.

Figure 12E:
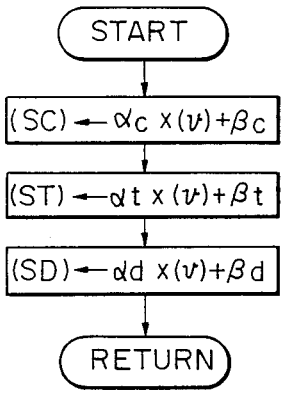

After the drum linear velocity (v) has been obtained, set current/voltage calculation processing shown in FIG. 12E is executed. Specifically, set voltage or current values (SC) (ST) and (SD) of the charger 14, transfer unit 24 and separator unit 26, respectively, are determined. The set values are such that they control the amounts of charge of their associated electrodes to predetermined values with no regard to the drum linear velocity. As regards the set value (SC), for example, it is produced by multiplying a drum linear velocity (v) by a constant $\alpha c$ which is related to drum linear velocity and, then, adding to the product a constant $\beta c$ which is not related to drum linear velocity. The constants $\alpha c$ and $\beta c$ are dependent upon the charging characteristic of the charger 14. This is true with the other set values (ST) and (SD). Constants which are determined by the characteristic of the transfer charger 24 and those which are determined by the characteristic of the separator 26 are represented by $\alpha t$ and $\beta t$ and $\alpha d$ and $\beta d$, respectively.

Figure 10A:
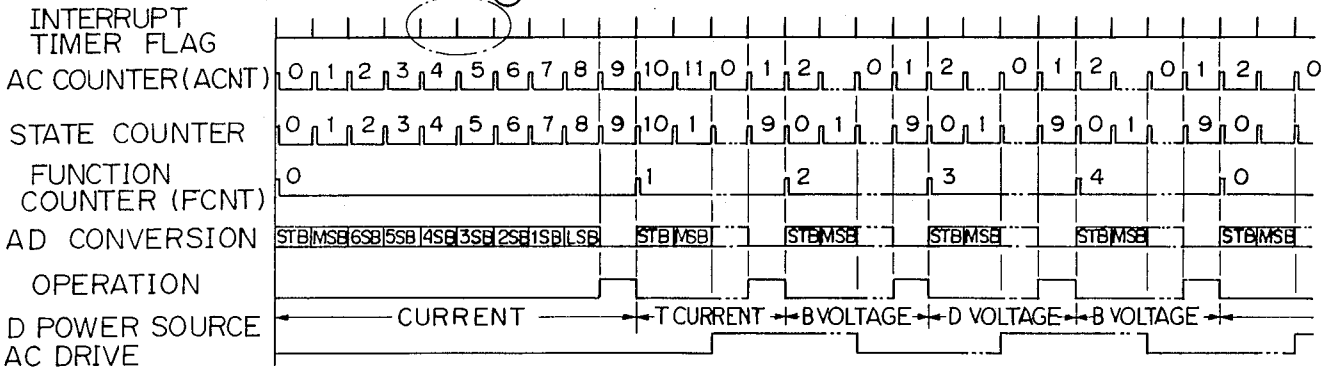
FIG. 10A is a timing chart demonstrating a specific operation of a microcomputer as shown in FIG. 9.
Figure 10B:
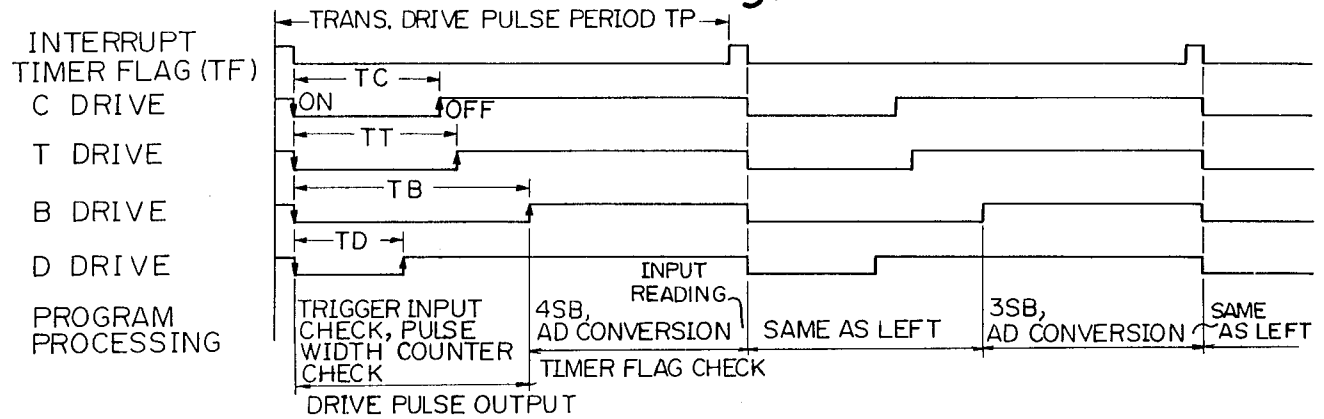
FIG. 10B is a timing chart showing in an enlarged scale a part of the timing chart of FIG. 10A.
Figures 1, 2, 11A:
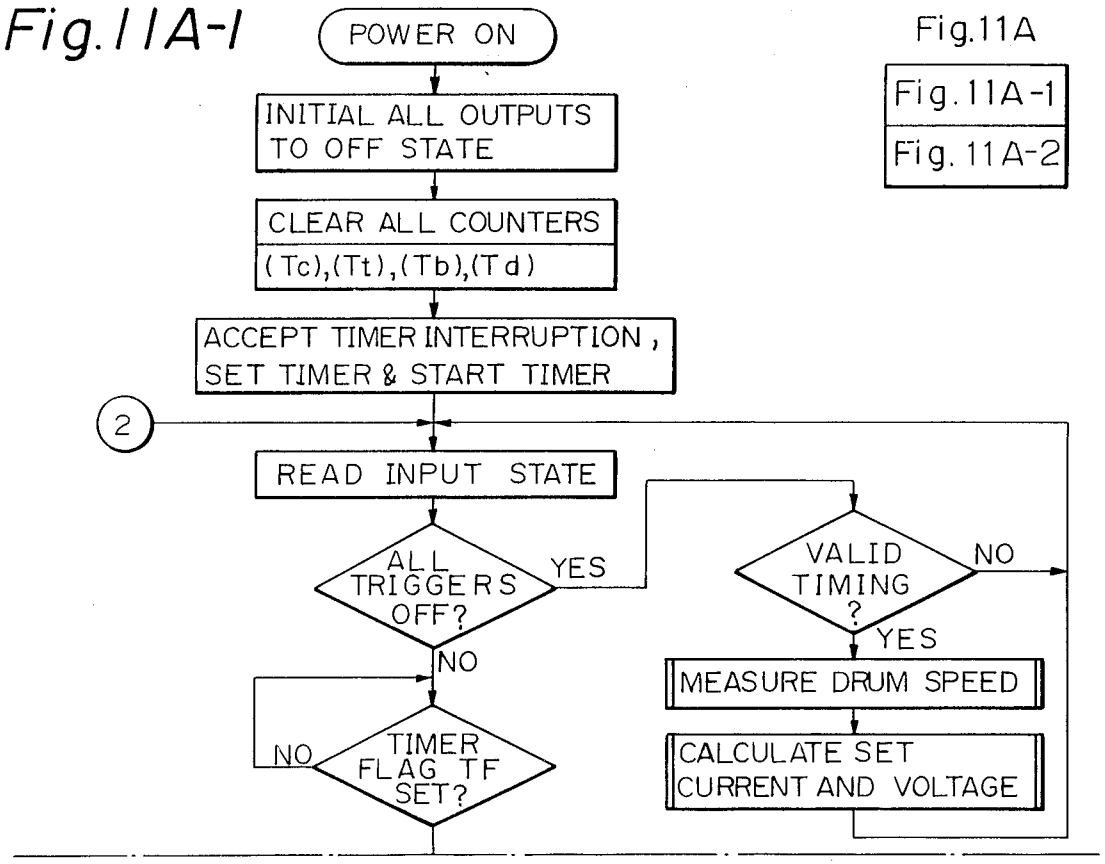
FIGS. 11A and 11B are flowcharts outlining the operation of the microcomputer of FIG. 9.
Figures 2, 11A:
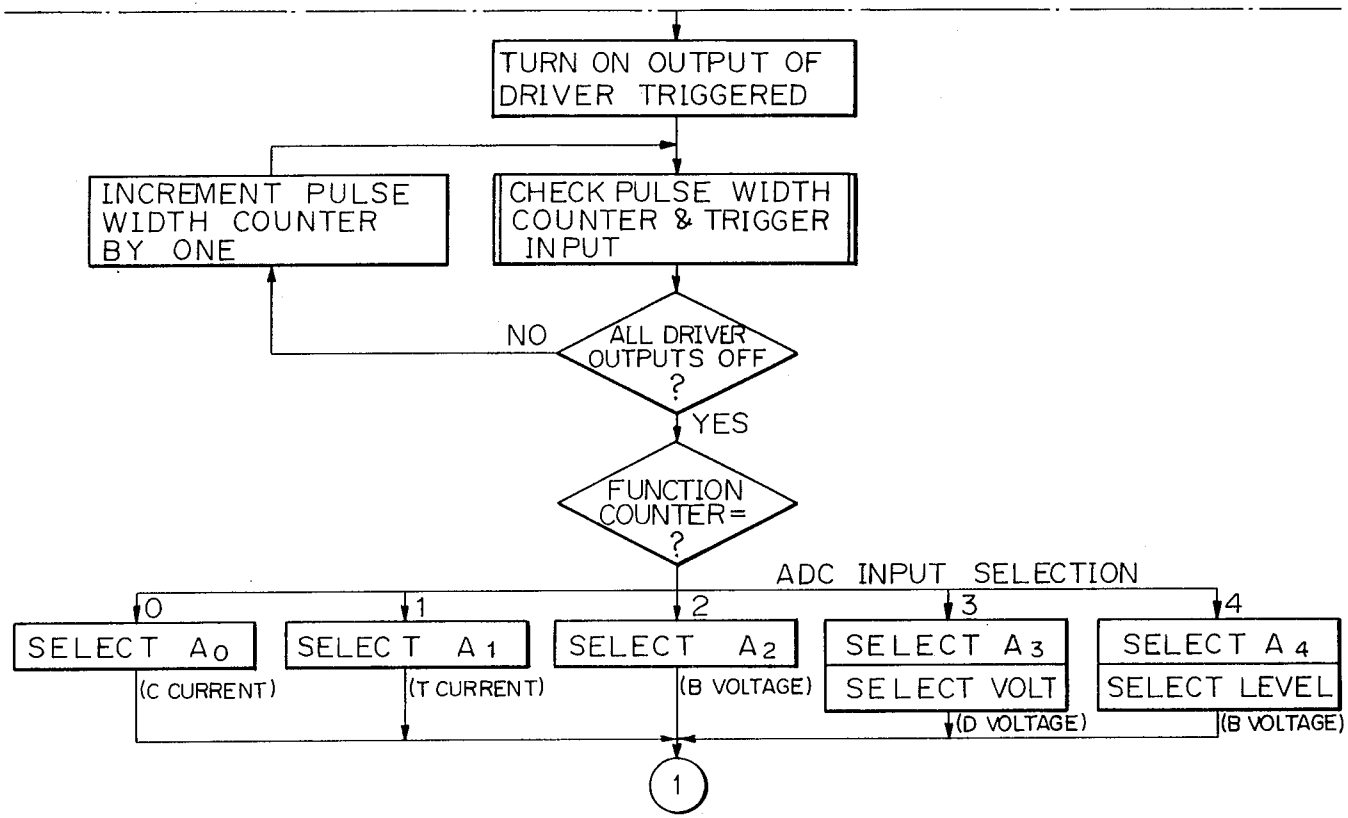
Figures 1, 2, 11B:
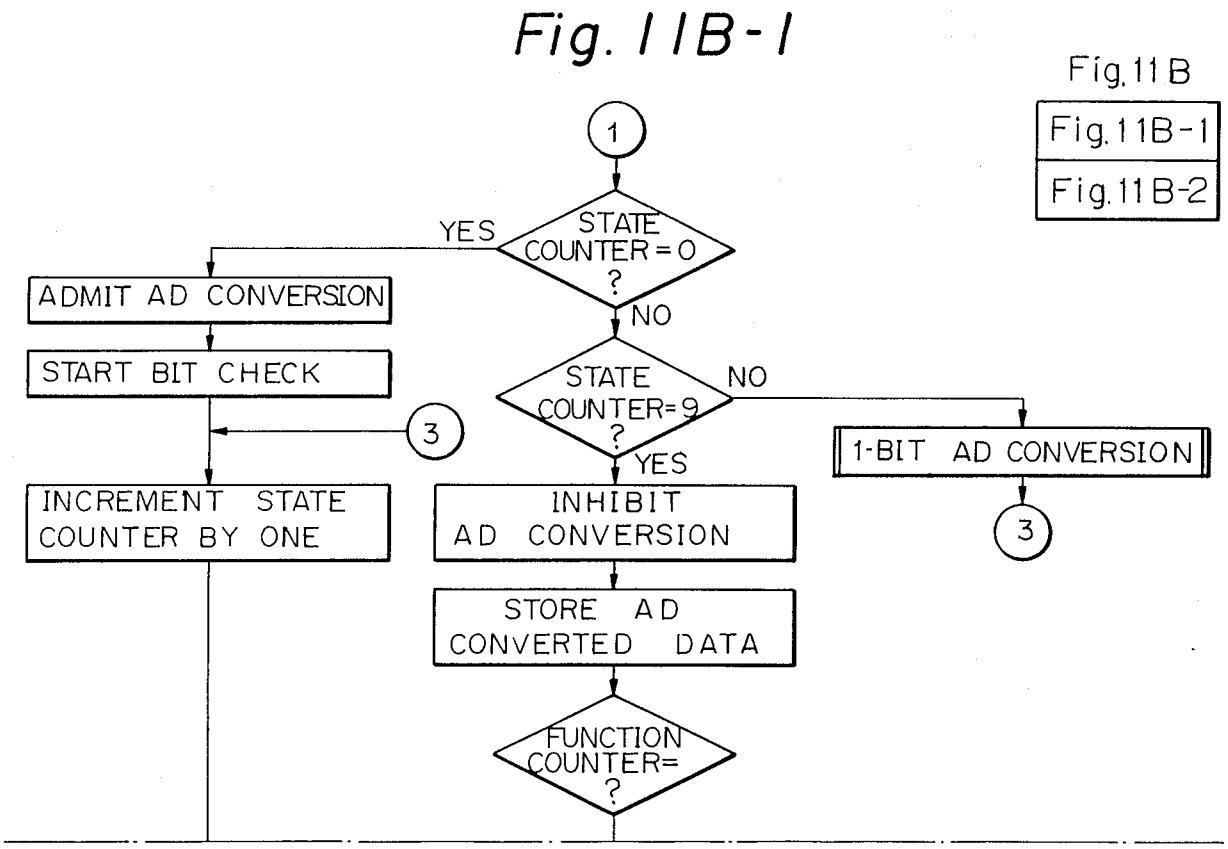
Figures 2, 11B:
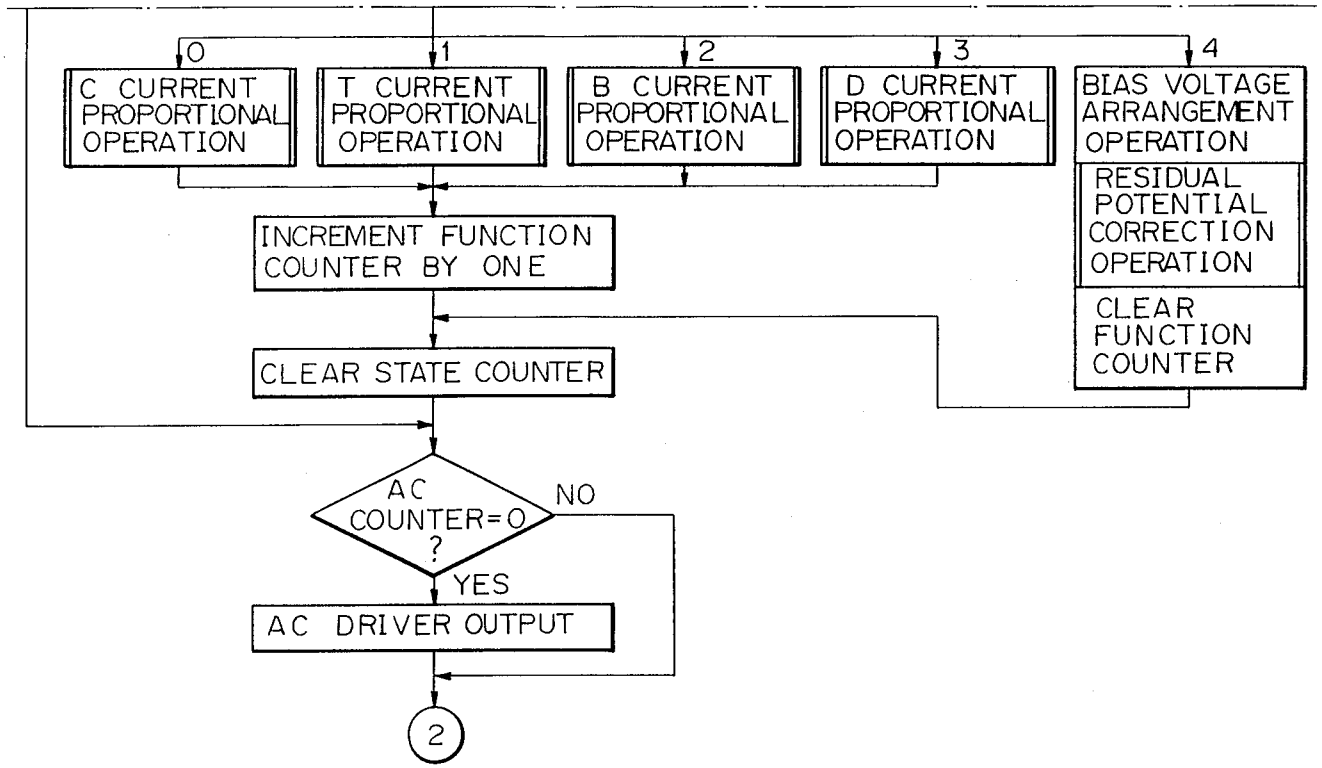

When any of the triggers becomes ON, loop processing is executed. First, the timer flag TF is checked to see if it has been set. If the timer flag TF has been set, the program advances to the next step. The driver output trigger is turned ON. Specifically, when inputs CTRIG, TTRIG, STRIG and DTRIG are ON, driver outputs CDRIVE, TDRIVE, SDRIVE and DDRIVE associated therewith are turned ON (if DDRIVE ON, ACNEGA is turned ON also). That is, if all the triggers are ON, the respective drive output levels are set to low level, timed to the interruption timing, as shown in FIG. 10B.

Figure 12F:
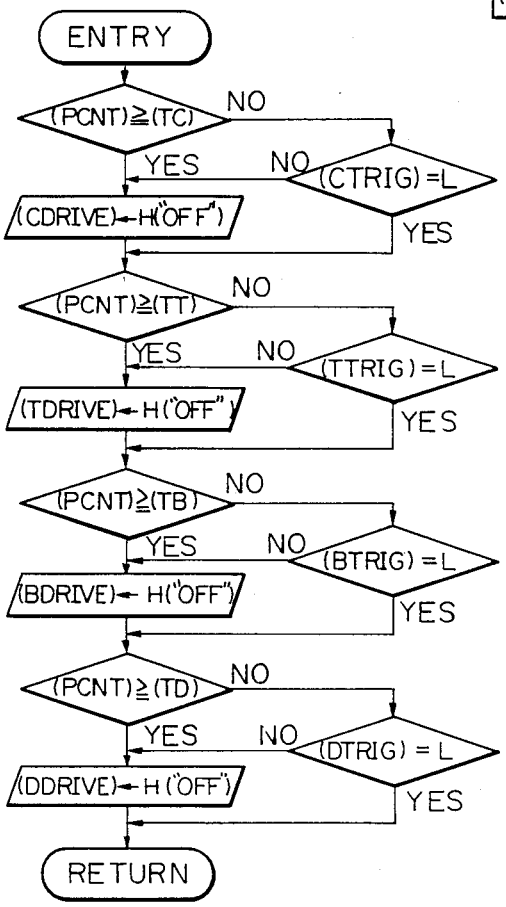

Next, the widths of pulses, each adapted to control the voltage or the current of a particular drive output, are controlled by pulse width counter check and trigger input check processing, as shown in FIG. 12F. Every time this processing is completed, a pulse width counter PCNT is incremented by one. As soon as all the drive outputs become OFF level (H), the programs leaves the pulse width control.

Specifically, in FIG. 12F, the pulse width counter (PCNT) which is initially loaded with zero is sequentially incremented at a predetermined period. The content of the counter (PCNT) is sequentially compared with those of pulse width registers (TC), (TT), (TB) and (TD) of the respective output lines. When the pulse width counter (PCNT) coincides the pulse width register of any of the output lines or when the trigger input becomes OFF-level (H), a driver output (CDRIVE), (TDRIVE), (BDRIVE) or (DDRIVE) associated with that line is set to OFF level (H). More specifically, as shown in FIG. 10B, a pulse signal which becomes low level timed to the generation of a timer interruption, becomes high level upon the lapse of a period of time corresponding to the associated pulse width register, and repeats such changes at the same period as the timer interruption period appears on each of the driver outputs (CDRIVE),) (TDRIVE), (BDRIVE) and (CDRIVE).

When all the driver outputs become OFF, the content of a function counter (FCNT) is checked to execute particular processing. Specifically, the function counter (FCNT) is initially loaded with "0" and performs loop processing. Every time a state counter which will be described changes from "0" through "9" (i.e. every time the loop processing is executed ten times), the function couner (FCNT) is incremented by one. Every time the function counter (FCNT) reaches "4", it is cleared to "0". When the content of the function counter (FCNT) is "0", "1", "2", "3" or "4", there are selected, respectively, a feedback signal from a C power source output, a feedback signal from a T power source output, a feedback signal from a B power source output, a feedback signal from a D power source output, or a residual potential signal, as an input signal to the AD converter ADC.

Figure 12G:
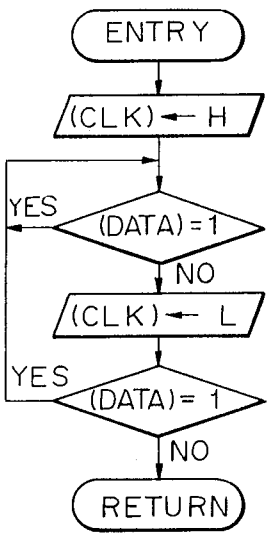

Subsequently, the content of the state counter (SCNT) is checked to perform particular processing. Specifically, the state counter (SCNT) is initially loaded with "0" and, every time the loop processing is executed, incremented by one. As the state counter (SCNT) reaches "9", it is cleared to "0". When the state counter (SCNT) is "0", AD conversion is permitted ((CS) is set to low level) and, then, the program advances to start on bit check as shown in FIG. 12G.

First, high level is applied to the clock terminal of the AD converter ADC and, when the data terminal DATA become low level, high level is applied to the clock terminal CLK. If the data terminal DATA is low level, it is decided that a start bit has been detected.

After the output of a start bit, the AD converter ADC digitizes the levels of an input analog signal one bit at a time in synchronism with the change of the level on the clock terminal CLK from high level to low level, the digital bit data being set on the data terminal DATA.

Figure 12H:
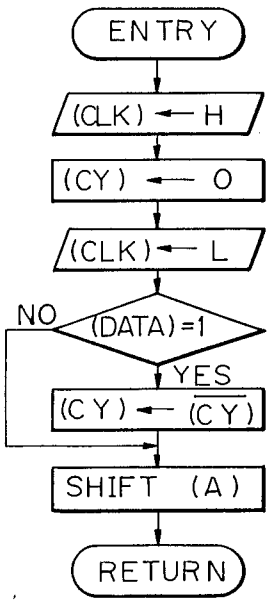

After the detection of a start bit, one-bit AD conversion processing shown in FIG. 12H is executed once per loop processing from the instant when the state counter assumes any of "1" to "8". First, high level is set on the clock terminal (CLK) of the AD converter ADC, a carry flag (CY) is cleared, and low level is applied to the clock terminal CLK. At this timing, the AD converter ADC produces one bit of digital data on the data terminal DATA while, at the same time, the level of that terminal is checked. If the level on the data terminal DATA is high, the content of the carry flag (CY) is inverted (to produce a complement) ; if it is low level, the content of an accumulator (A) inclusive of the carry flag (CY) is bit-shifted. When such is repeated eight consecutive times, i.e. , when the loop processing is repeated eight consecutive times after the detection of a start bit, all of the eight bits are completely converted into digital data and left in the accumulator (A).

Upon completion of the AD conversion, the state counter (SCNT) reaches "9". If the state counter is "9", the AD conversion is inhibited (with high level applied to the terminal CS of ADC) while, at the same time, the eight bits of data left in the accumulator (A) are stored in a predetermined memory area. Based on the content of the function counter, the next processing is selected. Specifically, when the function counter is "0", "1", "2", "3" or "4", there is selected, respectively, C current proportional operation, T current proportional operation, B voltage proportional operation, D current proportional operation, or bias voltage arrangement operation and drum potential correction operation.

Figure 12I:
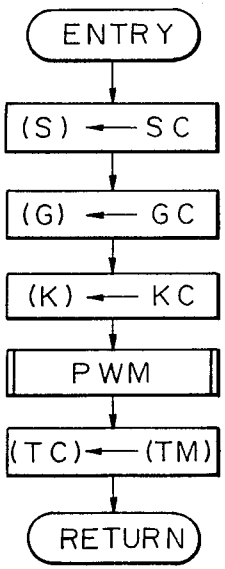
Figure 12J:
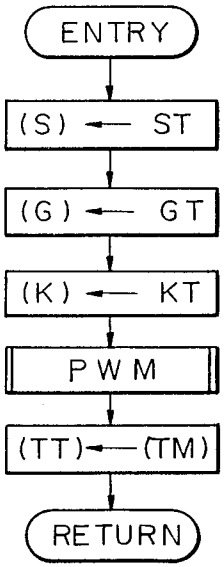
Figure 12K:
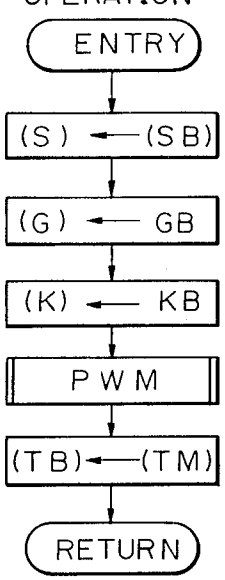
Figure 12L:
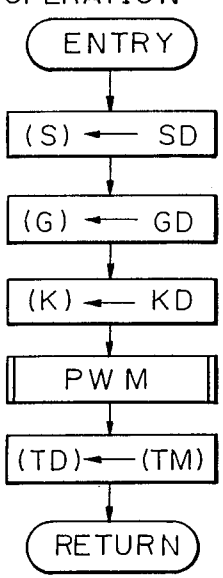
Figure 12M:
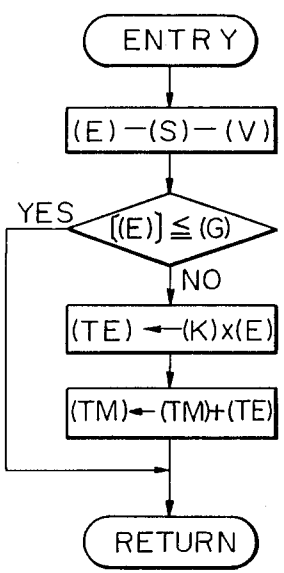

Referring to FIGS. 12I and 12M, C current correction operation is shown. A set value register (S) is loaded with the set value SC of the C power source output current, a gap register (G) is loaded with a reference value GC, and a proportional gain register (K) is loaded with a proportional gain (KC). Then the program advances to a subroute <PWM>. In the subroutine <PWM>, the content of an detected value register (V) (adapted to hold AD-converted feedback data) is subtracted from that of the set value register (S), the result being stored in a deviation register (E).

The absolute value of the content of the deviation register (E) is compared with that of the gap register (G). If the deviation of the detected value from the set value is greater than predetermined one, the content of the deviation register (E) is multiplied by that of the proportional gain register (K), the result being stored in a pulse width counter manipulation amount register (TE). Then, the content of a pulse width counter set value register (TM) is added to that of the pulse counter manipulation amount register (TE). So long as the deviation of the detected value from the set value is smaller than predetermined one (G), the content of the register (TM) is not changed in order to eliminate hunting due to overcontrol.

After the subroutine <PWM>, the content of the pulse width counter set register (TM) is stored in a pulse width register (TC) associated with the C power source. The T current proportional operation, B voltage proportional operation and D voltage proportional operation are essentially the same as the C current correction operation except that the set value SC is replaced with ST, (SB) and SD, the reference value GS is replaced with GT, GB and GD, and the proportional gain KC is replaced with KT, KB and KD.

Figure 13:
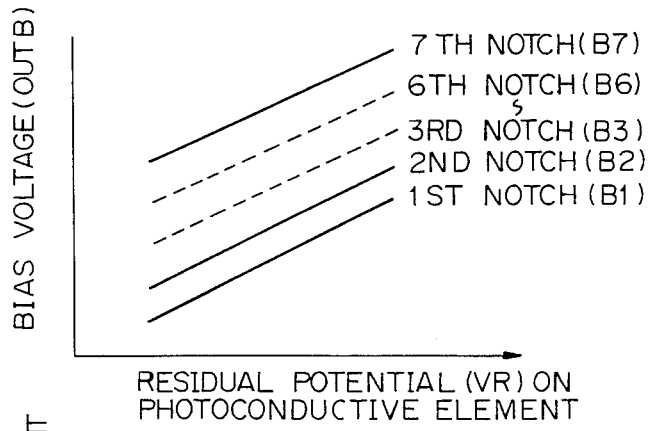
FIG. 13 is a graph showing a relationship between a residual potential on a photoconductive element and a bias voltage.

What should be noted here is that, to develop a latent image without contaminating the background, the set values SC and (SB) have to be changed, in contrast to the set values ST and SD which are fixed. For example, the B power source output (bias voltage) has to be changed in matching relation to bias control (3-bit data as represented by b0, b1 and b2 in FIG. 9) and the residual potential on the drum 12. Generally, as shown in FIG. 13, a developing bias voltage (B power source output) has to be increased in proportion to a residual potential (VR) on a photoconductive element (for the purpose of maintaining the developing characteristic constant). Further, when the density is to be adjusted on an operation board by way of example, the bias voltage has to be increased or decreased stepwise by each predetermined value corresponding to one notch. Specifically, the output voltage OUTB (set value) of bias voltage is set as produced by:

$$OUTB=(Vp)\times D+(B)\ [V]$$

where (Vp) is a voltage correction amount based on an output level of the pattern sensor 22 representative of a residual potential, D is a constant determined by the characteristics of a phototoconductive drum, and B is a voltage adjustment amount.

Figure 12N:
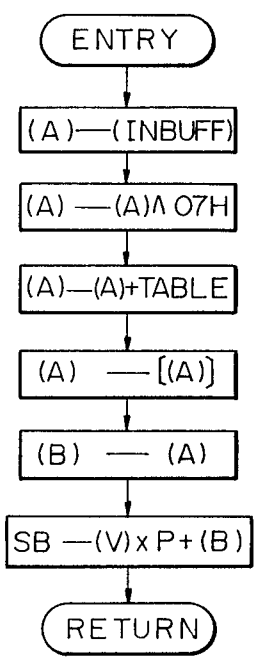

Referring to FIG. 12N, the residual potential correction begins with transferring the content of an input buffer (INBUFF), i.e., statuses of input ports P20 to P27 to the accumulator (A). This content of the accumulator (A) and 07H (hexadecimal) are ANDed to extract lower three bits, i.e., bias control data. The bias control data is added to a head address table of a bias voltage data table to thereby generate a table reference address. Table data read out on the basis of the table reference address is stored in a register (B), residual potential data is stored in the register (V), and (V)×P+(B) is operated to store the result in a set value register (SB). It is to be noted that the bias voltage data table is constituted by an eight-byte continuous memory area which begins with the address table, the addresses individually storing eight-bit data corresponding to voltage adjustment amounts (B), the smallest one first.

Subsequently, an AC counter (ACNT) is checked and, if it is "0", the AC driver output is inverted. Specifically, if (ACPOSI) is low level and (ACNEGA) is high level, (ACPOSI) is set to high level and (ACNEGA) to low level. So long as the content of the AC counter is other than "0", the status of the AD driver output is not altered. As shown in FIG. 12L, in timer interruption, since the AC counter (ACNT) is incremented by one at a time and, as it reaches I ("12" in this example), cleared to "0", the AC counter becomes "0" once per twelve consecutive timer interruptions. Hence, the AC driver outputs (ACPOSI) and (ACNEGA) are inverted once per twelve periods of the timer interruption. Specifically, since the polarity of power applied to the primary winding of the transformer T4 changes once per twelve periods of the timer interruption, the polarity of the D power source output is changed at each twelve periods of the same and this corresponds to the frequency of AC voltage which is output by the D power source.

In the illustrative embodiment, the oscillation source of the microcomputer CPU is implemented with 11 megaherz quartz crystal. The basic clock oscillated by the quartz is divided so that the internal timer of the microcomputer CPU counts clock pulses of 43.6 microseconds. While the internal timer generates an interruption to set the flag TF when the count reaches "256", the timer flag TF is set every 87.2 microseconds because the timer is preset to "254 (N)".

Therefore, the above-stated loop processing occurs once per 87.2 microseconds. This implies that the ON/-OFF period of the pulse power adapted to energize the primary windings of the transformers T1, T2, T3 and T4 is 87.2 microseconds. As regards the operation of the microcomputer CPU shown in FIGS. 11A and 11B, the AD conversion processing for sampling the feedback signal of one power source line is executed once per nine periods, i.e., once per 784 microseconds inclusive of the start bit check, and set value operation processing for one power source line is executed in the subsequent one period.

In this particular embodiment, since four power source lines are present and since sampling of residual potential on the drum 12 and the correction of bias voltage are performed, the above processing is repeated five times in total. It follows that the whole procedure is completed once in every fifth processing periods, i.e. 4.36 milliseconds. Therefore, even when a change in load or the like has occurred, processing for compensating for it is completed in 4.36 milliseconds at maximum. The AC period of D power source corresponds to twenty-four periods of the timer interruption and, therefore, approximately 2.01 milliseconds in the illustrative embodiment.

While in this embodiment a plurality of power source lines are controlled on a time sharing basis by a single microcomputer, pulse width control may be effected by an analog system which uses a saw-tooth wave generator, an analog comparator, a reference voltage generator and others as has heretofore been practiced. Nevertheless, the illustrative embodiment is advantageous over such a traditional system because the control over a plurality of power sources by a single controller simplifies the overall circuitry and because the digital control is immune to noise and, therefore, promotes the ease of adjustment.

As discussed earlier, when the visible pattern is formed each time by a constant developing bias voltage, e.g., voltage under the initial condition of a photoconductive element, the potential for producing the visible pattern increases with the residual potential on the photoconductive element. This results in wasteful consumption of toner, saturation of toner density, etc.

In the light of the above, in the illustrative embodiment, the visible pattern is formed by a corrected amount of potential of a developing bias which is corrected on the basis of the level of a visible pattern as sensed immediately before. For example, as shown in FIG. 4, assuming that the developing bias voltage which is 200 volts at first is increased to 240 volts based on the level of a visible pattern sensed immediately before, the visible pattern is formed by the corrected amount of potential (40 volts). The resulting visible pattern has density which is substantially the same as that of a visible pattern which is formed in the initial stage, whereby the drawbacks discussed above are eliminated. In this instance, the developing bias voltage is sequentially added stepwise based on, for example, the result of visible pattern detection which occurs once per predetermined number of copies produced.

Figure 14:
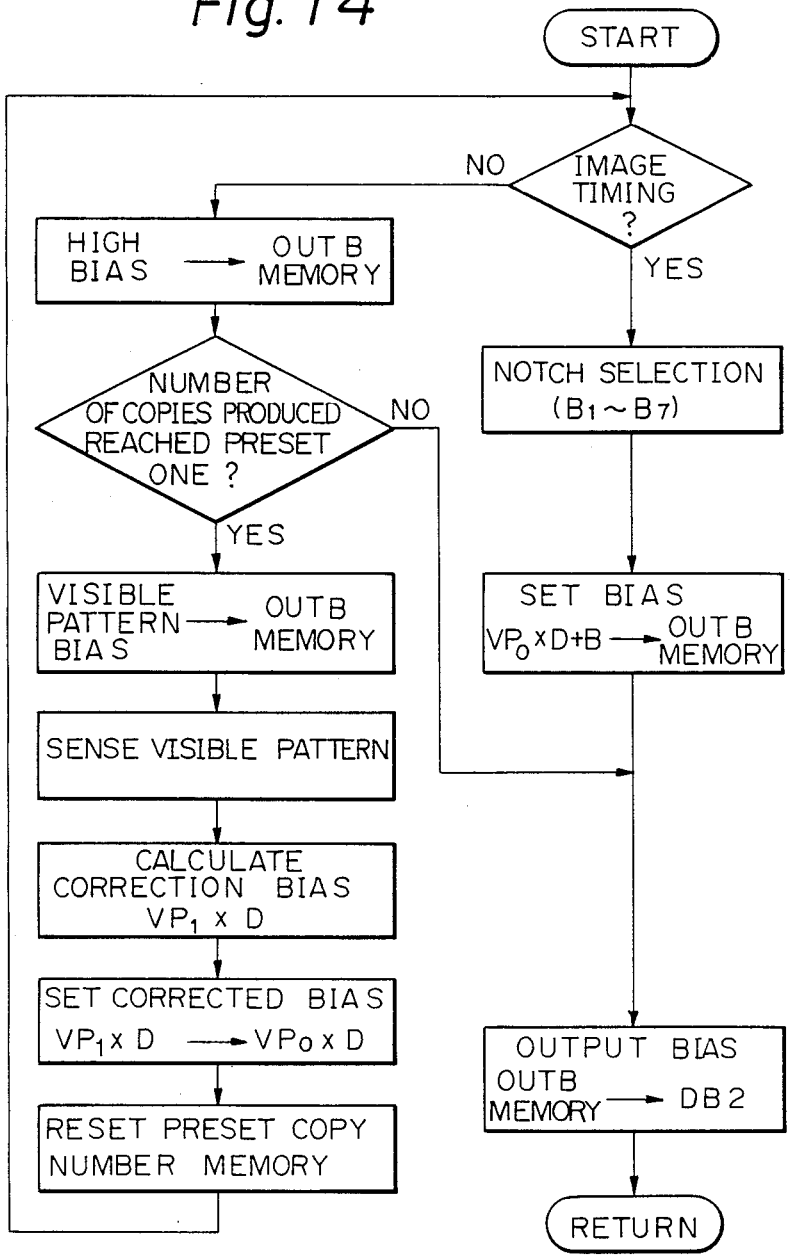
FIG. 14 is a flowchart demonstrating a developing bias control operation.

How the visible pattern is formed and how the developing bias voltage is controlled in accordance with the illustrative embodiment will be described with reference to FIG. 14.

A copying cycle effected by a copier begins at a timing other than an image area timing. Specifically, whether the copying cycle is at a timing other than the image area timing is decided. If it is not at the image area timing, a developing bias higher than the residual potential on the photoconductive element is loaded in a memory which is adapted for bias output (memory OUTB), in order to prevent toner from adhering to the photoconductive element.

Then, whether the actual number of copies produced (cumulative value of the copying cycles performed with the drum 12) has reached a predetermined number is determined. Since the residual potential on the drum 12 usually does not increase more than one notch of bias voltage after 1,000 to 10,000 copies have been produced, a timing for correcting the developing bias is determined by experiments with the above-mentioned increase in the residual potential taken into account, and the number of copies of that instant (500 to 1,000 copies as regarding the timing which is associated with the above-mentioned rate of increase) is used for the predetermined number of copies. If the actual number of copies is short of the predetermined number of copies, data corresponding to the bias output memory OUTB is applied to a port DB2 resulting that a high bias voltage is fed to the developing sleeve.

If the actual number of copies is greater than the predetermined one, the value of a visible pattern bias (minimum bias) is loaded in the bias output memory (substituting the previous data) so that the visible image pattern bias (see FIG. 3A) is applied to the developing sleeve of the developing unit 20. Consequently, toner is deposited on the drum 12 based on the residual potential of the latter, forming a visible pattern (see FIG. 3B).

Under the above condition, the pattern sensor 22 senses the visible pattern (FIG. 8) so that a new corrected bias amount $Vp_1 \times D$ is calculated and substituted for the previous corrected bias amount Vphd $0 \times D$. The new corrected bias amount $Vp_1 \times D$ immediately begins to be treated as a corrected bias amount $Vp_0 \times D$.

Thereafter, the memory storing the predetermined number of copies is reset and, then, the program returns to the decision concerning the image area timing. As the copying cycle reaches the image area timing, a particular amount of voltage adjustment B is selected based on notch selection data which is entered on the operation board by an operator. The corrected bias amount $Vp_0 \times D$ is added to the amount B selected in order to set up a bias for an image area, the bias being delivered as a developing bias.

In the illustrative embodiment, the smears in the background due to an increase in the residual potential on the drum 12 are eliminated by correcting the developing bias voltage which is applied to the developing unit 20. If desired, however, such a purpose may be achieved by correcting the charging grid voltage of the charger 14 and/or the exposing voltage applied to the optics 16. The charging grid voltage, developing bias voltage and exposing voltage are each corrected, or increased, stepwise based on the rate of increase of residual potential, i.e. the ratio of the output level (VSR) of the pattern sensor 22 representative of the visible pattern to the output level of the same representative of a non-pattern area (VSG), as shown in FIG. 4 by way of example.

However, as discussed earlier, when the quantity of light issuing from the eraser is reduced due to scattering of toner and other causes, the residual potential due to aging of the drum 12 and the residual potential due to the short quantity of light issuing from the eraser are added together. Such a residual potential is not equal to the residual potential of the drum 12 only.

Figure 15:
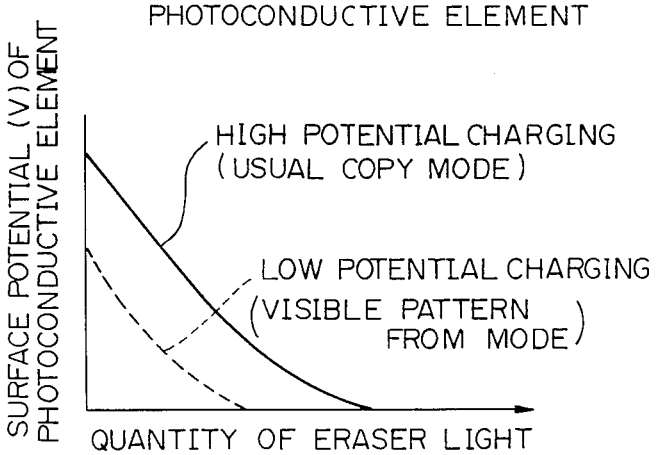
FIG. 15 is a graph showing a relationship between a surface potential on a photoconductive element and a quantity of light issuing from an eraser.

To solve this problem, in the illustrative embodiment, the drum 12 is charged before the formation of the visible pattern by a lower potential than a charging potential for usual copying (but higher than a residual potential ascribable solely to the drum 12), and the visible pattern is formed by a residual potential which remains on the drum 12 after such a particular potential has been erased. Since the charge potential removed by the eraser is lower than the charge potential for usual copying, it can be fully removed even if the eraser becomes short of the quantity of light, as illustrated in FIG. 15, allowing only the potential which is ascribable to the drum 12 and cannot be removed to remain on the drum 12. It follows that the visible pattern provided by such a residual potential promotes accurate correction of drum potential.

Figure 16:
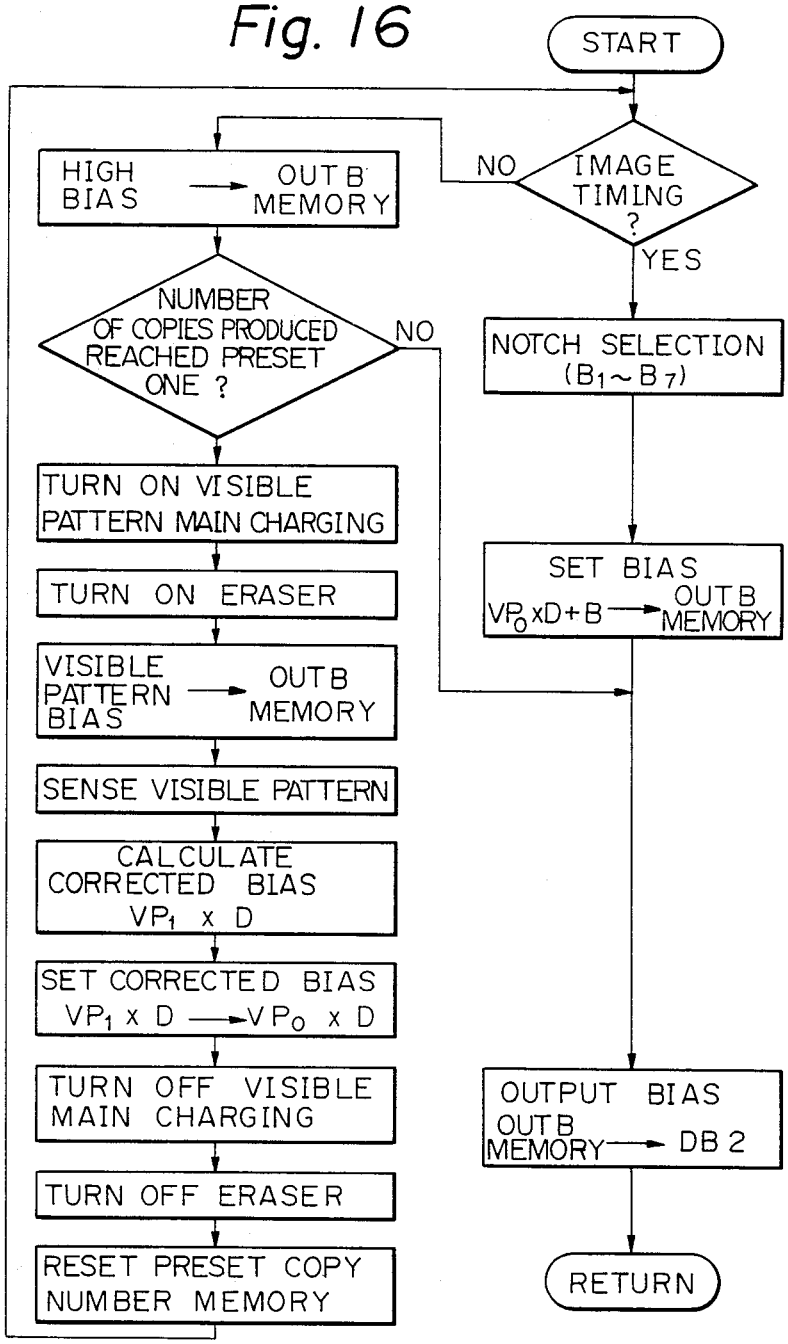
FIG. 16 is a flowchart showing a visible pattern forming procedure.

A specific control operation for forming the visible pattern will be described with reference to FIG. 16.

A copying cycle effected by a copier begins at a timing other than an image area timing. Specifically, whether the copying cycle is at a timing other than the image area timing is decided. If it is not at the image area timing, a developing bias higher than the residual potential on the photoconductive element is loaded in the memory which is adapted for bias output (memory OUTB), in order to prevent toner from adhering to the photoconductive element.

Then, whether the actual number of copies produced (cumulative value of the copying cycles performed with the drum 12) has reached a predetermined number is determined. Since the residual potential on a photoconductive drum usually does not increase more than one notch of bias voltage after 1,000 to 10,000 copies have been produced, a timing for correcting the developing bias is determined by experiments with the above-mentioned increase in the residual potential taken into account, and the number of copies of that instant (500 to 1,000 copies as regards the timing which is associated with the above-mentioned rate of increase) is used for the predetermined number of copies. If the actual number of copies is short of the one, data corresponding to the bias output memory is applied to the port DB2 resulting that a high bias voltage is fed to the developing sleeve.

If the actual number of copies is greater than the predetermined one, main charging for forming a visible pattern is turned ON to charge the drum 12 by a lower voltage than a voltage for usual copying. Thereafter, the eraser is turned ON to erase the charge on the drum 12. All that remains on the drum 12 then is the potential which is attributable to aging of the drum 12.

The value of a visible pattern bias (minimum bias) is loaded in the bias output memory (substituting the previous data) so that the visible image pattern bias (see FIG. 3A) is applied to the developing sleeve of the developing unit 20. Consequently, black toner is deposited on the drum 12 based on the residual potential of the latter, forming a visible pattern (see FIG. 3B).

Under the above condition, the pattern sensor 22 senses the visible pattern (FIG. 8) so that a new corrected bias amount $Vp_1 \times D$ is calculated and substituted for the previous corrected bias amount $Vp_0 \times D$. The new corrected bias amount $Vp_1 \times D$ immediately begins to be treated as a corrected bias amount $Vp_0 \times D$.

Thereafter, the visible pattern main charging and the eraser are turned OFF, the memory storing the predetermined number of copies is reset, and the program returns to the decision concerning the image area timing.

As the copying cycle reaches the image area timing, a particular amount of voltage adjustment B is selected based on notch selection data which is entered on an operation board by an operator. The corrected bias amount $Vp_0 \times D$ is added to the amount B selected to set up a bias for an image area, the bias being delivered as a developing bias.

Hereinafter will be described another embodiment of the present invention which is applied to a multi-color electrophotographic copier.

Figure 17:
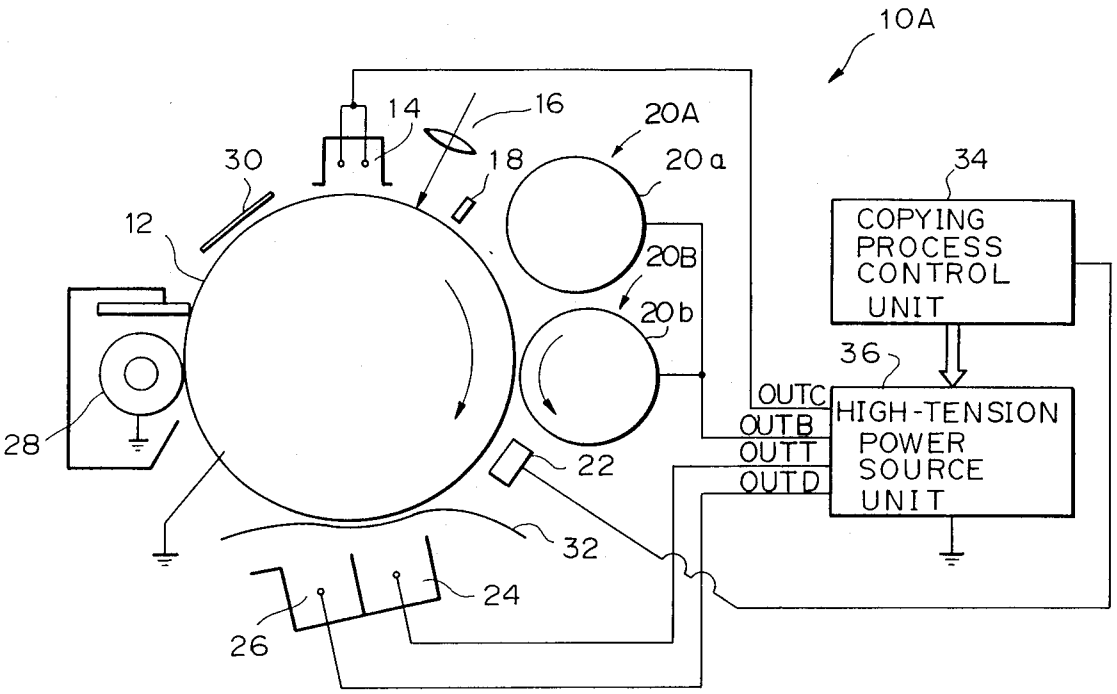
FIG. 17 is a schematic diagram showing a drum, various elements arranged around the drum, and a power source device of a multi-color electrophotographic copier to which the present invention is applied.

As shown in FIG. 17, the drum 12 of a multi-color electrophotographic copier 10A, like that of the copier 10 of FIG. 7, is surrounded by the charger 14, eraser 18, pattern sensor 22, transfer unit 24, separator unit 26, cleaning unit 28, and discharger 30. A difference is that the copier 10A includes two independent developing units 20A and 20B. The developing unit 20A includes a developing sleeve 20*a* and supplies red, blue, green or like color toner to the drum 12 to develop an electrostatic latent image carried thereon. On the other hand, the developing unit 20B includes a developing sleeve 20*b* and supplies black toner to the drum 12 to develop a latent image in black. These developing units 20A and 20B are selectively operated depending upon the copy mode. Specifically, the developing units 20A and 20B are selected in a color copy mode and in a usual copy mode, respectively, and operated each on the basis of a predetermined copying process. FIG. 17 shows an exemplary condition in which the black developing unit 20B is set and the color developing unit 20A is reset. The developing sleeves 20*a* and 20*b* of the developing units 20A and 20B, respectively, are connected to the bias output terminal OUTB of the high-tension power source unit 36.

Figure 18:
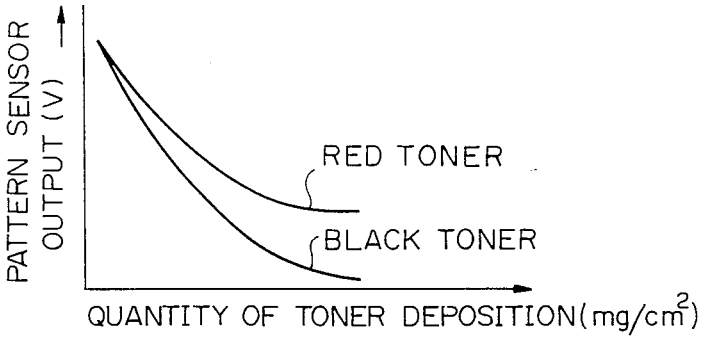
FIG. 18 is a graph showing a relationship between an output of the pattern sensor and an amount of toner deposition.

In the copier 10A, the quantity of light incident to the light-sensitive element 22*b* of the pattern sensor 22 and, therefore, the output of the pattern sensor 22 differs from black toner to red toner even if a pattern developed by black toner and a pattern developed by red toner have the same density, i.e., even if the amounts of toner deposited are the same, as shown in FIG. 18 by way of example. This is because reflectivity depends upon the color of toner.

For the above reason, in the copier 10A having a plurality of developing units 20A and 20B which store different colors of toner, the output level of the pattern sensor 22 changes with the color of toner. In this condition, there is a fear that adequate correction of bias voltage which matches with an instantaneous residual potential on the drum 12 is obstructed.

To cope with the above situation, this particular embodiment uses only one of the developing units, i.e., only the toner of predetermined color in forming the visible pattern. While the particular toner for forming the visible pattern may be of any color insofar as its reflectivity is the same, it is advantageous to limit it to black toner considering the fact that color toner is replaceable as needed. Another advantage attainable with black toner is that, as shown in FIG. 18, it allows the output of the pattern sensor 22 to vary over a wide range and, therefore, the previously stated control over developing bias voltage to be effected with ease.

A specific procedure for selecting the kind of toner for forming the visible pattern (i. e. setting the developing unit 20B which stores black toner at the time of forming the visible pattern in this embodiment) is as follows.

Figure 19:
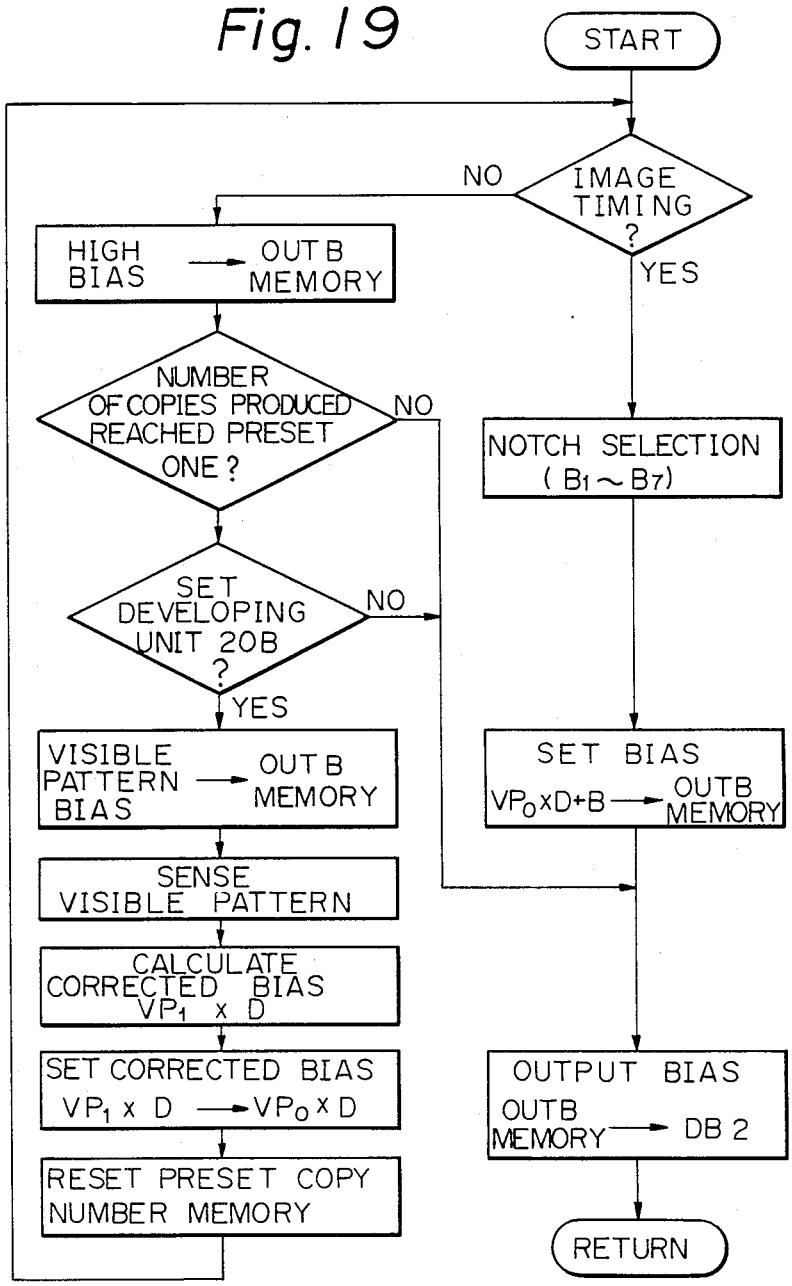
FIG. 19 is a flowchart demonstrating a sequence of steps for selecting one of developing units as shown in FIG. 17.

As shown in FIG. 19, the copying cycle of the copier 10A begins at a timing other than an image area timing. The program begins with deciding whether the copying cycle is at a timing other than the image area timing. If the answer is NO, a developing bias whose value is higher than the residual potential on the drum 12 is loaded in the bias output memory (memory OUTB) in order to prevent toner from adhering to the drum 12.

Subsequently, whether the actual number of copies (cumulative number of copying cycles performed with the drum 12) has reached desired one is determined. Since the residual potential on the drum 12 usually does not increase more than one notch of bias voltage after 1,000 to 10,000 copies have been produced, a timing for correcting the developing bias is determined by experiments with the above-mentioned increase in the residual potential taken into account, and the number of copies of that instant (500 to 1,000 copies as regards the timing which is associated with the above-mentioned rate of increase) is used for the predetermined number of copies. If the actual number of copies is short of the predetermined one, data corresponding to the bias output memory is applied to the port DB2 resulting that a high bias voltage is fed to the developing sleeve.

If the actual number of copies produced has reached the desired one, whether the developing unit 20B (black toner) has been set is decided. If the answer is NO, a content corresponding to the bais output memory is fed to the port DB2 again so as to apply the high bias voltage to the developing sleeve being set. Which of the developing units 20A and 20B should be set is decided by an operator by selecting a particular copy mode (black/white copy mode or color copy mode) on the operation board.

If the actual number of copies has reached the desired one and the developing unit 20B has been set, the value of visible pattern bias (minimum bias) is loaded in the bias output memory replacing the previous content. Then, the visible pattern bias (see FIG. 3) is applied to the developing sleeve 20A of the developing unit 20B, so that the black toner is deposited on the drum 12 based on the residual toner to produce a visible pattern (see FIG. 3B).

Under the above condition, the pattern sensor 22 senses the visible pattern (FIG. 8) so that a new corrected bias amount $Vp_1 \times D$ is calculated and substituted for the previous corrected bias amount $Vp_0 \times D$. The new corrected bias amount $Vp_1 \times D$ immediately begins to be treated as a corrected bias amount $Vp_0 \times D$.

Thereafter, the memory storing the predetermined number of copies is reset and, then, the program returns to the decision concerning the image area timing. As the copying cycle reaches the image area timing, a particular amount of voltage adjustment B is selected based on notch selection data which is entered on the operation board by an operator. The corrected bias amount $Vp_0 \times D$ is added to the amount B selected to set up a bias for an image area, the bias being delivered as a developing bias.

It will be apparent that the illustrative embodiment described in relation to two developing units 20A and 20B is similarly applicable even to a full-color copier having three or more developing units.

While the foregoing description has concentrated on a single type of monocolor or multi-color electrophotographic copier, in a facilime apparatus or the like which moves a paper (charge carrier), all that is required is generating timing pulses associated with the movement of the paper and, based on a result of measurement of those pulses, setting voltages and currents.

In summary, in accordance with the present invention potential remaining in an area of a photoconductive element other than a document image forming area is developed by a bias voltage which is zero volt or lower than one for forming a document image, and the density of the resulting visible pattern is sensed by optical sensor means to correct a developing bias voltage. Further, the bias voltage for producing the visible pattern is increased stepwise in response to an increase in the residual potential on the photoconductive element, so that the visible pattern is produced by the potential of a bias which has been corrected based on the immediately preceding pattern detection level. This allows a minimum loss of toner to occur in the formation of such visible patterns and confines the density of visible patterns in a range which prevents the detection level from being saturated to thereby enhance accurate detection.

In addition, since scattering of developing bias voltage and others after correction is reduced by using toner of a particular color for the formation of the visible pattern, the potential on the photoconductive element can be corrected with accuracy.

Various modifications will become possible for those skilled in the art after receiving the teachings of the present disclosure without departing from the scope thereof.

What is claimed is:

1. A method for controlling a surface potential of a photoconductive element which is installed in an image-forming apparatus, comprising the steps of:

(a) charging an area of a surface of said photoconductive element other than an image-forming area for forming a document image which corresponds to an original document with a first potential which is lower than a charging potential for forming a document image, and erasing said first potential;

(b) producing a visible pattern by developing a potential which remains on said area of said photoconductive element other than said image-forming area after step (a), by using a developing bias potential which is lower than a developing bias potential for forming said document image;

(c) detecting density of said visible pattern; and (d) correcting at least one of a charging potential, an exposing potential and a developing bias potential which are to form said document image, based on said density detected.

2. A method as claimed in claim 1, wherein said density of said visible pattern detected in step (c) is optically detected.

3. A method as claimed in claim 1, wherein said developing bias potential for producing said visible pattern used in step (b) is zero.

4. A method as claimed in claim 1, wherein said image-forming apparatus comprises a multi-color electrophotographic copier which uses a plurality of colors of toner, toner used for development in step (b) being limited to one of said plurality of colors of toner.

5. A method as claimed in claim 4, wherein said one color of toner comprises black toner.

* * * * *